US005683730A

United States Patent [19]

Katsumata et al.

[11] Patent Number: 5,683,730

[45] Date of Patent: Nov. 4, 1997

[54] BREATHING APPARATUS OF A MOLD

[75] Inventors: Tetsuya Katsumata; Koji Katagiri; Iwao Morikawa, all of Gotenba, Japan

[73] Assignee: Showa Corporation, Saitama, Japan

[21] Appl. No.: 611,207

[22] Filed: Mar. 5, 1996

[30] Foreign Application Priority Data

Mar. 9, 1995 [JP] Japan ..... 7-077071

[51] Int. Cl.[6] ..... B29C 45/23

[52] U.S. Cl. ..... 425/562; 264/102; 425/812

[58] Field of Search ..... 425/562, 563, 425/812; 264/102

[56] References Cited

U.S. PATENT DOCUMENTS 4,779,667 10/1988 Fujino et al. ..... 425/812

4,787,436 11/1988 Ozeki et al. ..... 425/812

FOREIGN PATENT DOCUMENTS 6-7977 2/1994 Japan .

*Primary Examiner*—Tim Heitbrink

*Attorney, Agent, or Firm*—Armstrong, Westerman Hattori, McLeland & Naughton

[57] ABSTRACT

On mating surfaces of a pair of mold members are formed a breathing groove communicating with a cavity, a detection chamber for detecting a melt pressure at an end of the breathing groove, a detour groove diverging from the detection chamber and a valve chamber communicating with a vent passage at an end of the detour groove. A valve element of a shut-off valve member is positioned in the valve chamber and retracts to a valve closing position when the shut-off valve member moves in a direction perpendicular to and separating from the mating surface. A detection pin having an end fronting toward the detection chamber and a operation pin having an end fronting toward the valve chamber and abutting against the valve element are connected through a reverse mechanism so that the pins move in opposite directions to each other. When the detection pin detects a predetermined melt pressure in the detection chamber and retracts, the operation pin is projected into the valve chamber through the reverse mechanism and pushes the shut-off valve member to bring the valve element into the valve closing position.

3 Claims, 5 Drawing Sheets

BREATHING APPARATUS OF A MOLD

BACKGROUND OF THE INVENTION

The present invention relates to a mold for die casting or injection moulding and particularly a breathing apparatus of the mold for venting gas from a cavity on molding.

In die casting, since a melt is pressed in a cavity at high velocity and high pressure, reaction gases and air are caught in the melt to produce gross porosities in the casting and there are fears that strength of the casting is lowered and dispersion of the quality occurs.

Therefore, many kinds of apparatuses for venting gas from the cavity on pouring the melt have been proposed. FIG. 8 shows a customary example (Japanese Patent Publication No. Hei 6-7977).

FIG. 8 shows a section of an essential part of a mold which is in a closed state with a fixed mould member 01 and a movable mold member 02 joined together. Along mating surfaces of the mold members 01, 02 are formed a breathing groove 03, an operation chamber 04, a detour passage 05 and a vent chamber 06. The movable mold member 02 has a vent passage 07 communicating with the vent chamber 06, a pressure receiving pin 08 and a shut-off pin 09 having a diameter smaller than that of the pin 08. The pins 08, 09 are capable of reciprocating in the direction perpendicular to the mating surface and connected, respectively, to both ends of a lever 010 pivotally supported at the center to constitute a reverse mechanism.

A cylindrical pressing pin 011 is slidably arranged behind the pressure receiving pin 08 and a stopper bolt 012 inserted within the pressure pin 011 is forced by a compression spring 013 to abut against an end of the pressure receiving pin 08 for forcing the pin 08 toward the mating surface.

FIG. 8 shows a state of the apparatus before molding in which the pressure receiving pin 08 is forced by the compression spring 013 to be positioned at a predetermined initial position and the shut-off pin 09 connected to the pin 08 by the lever 010 is retracted from the vent chamber 06 to connect the vent chamber 06 with the vent passage 07.

In this state, when a pressurized melt is injected into the cavity, an air in the cavity and a reaction gas from a mould release agent pass through the breathing groove 03, the operation chamber 04, the detour passage 05, the vent chamber 06 and the vent passage 07 in order and are discharged out of the mold.

The melt having filled the cavity flows into the breathing groove 03 pushing out the gas in the aforementioned order and reaches the operation chamber 04 where the pressure of the melt is increased because of an abrupt change of direction toward the detour passage 05 to push-in the pressure receiving pin 08 against the compression spring 013. At the same time, the shut-off pin 09 is moved in the opposite direction through the lever 010 to close the opening end of the vent passage 07.

Since the melt passes through the detour passage 05 after having filled the operation chamber 04, the vent passage 07 is closed before the melt reaches the vent chamber 06 so that the melt does not spout outside.

As the pressure receiving pin 08 has a pressure receiving area larger than that of the shut-off pin 09, even if the melt reaches the vent chamber 06, the shut-off pin 09 does not retreat and keep its closing position.

Since breathing is carried out in such manner, no gas is intermixed in the melt within the cavity and a moulded article without gross porosities can be cast.

After moulding, the movable mold member 02 moves to separate from the fixed mold member 01, materials solidified in the breathing groove 03, the operation chamber 04, the detour passage 05 and the vent chamber 06 are pushed out by push-out pins together with the molded article and at the same time the pressure receiving pin 08 is returned to the initial position by the compression spring 013.

According to the aforementioned mould, actuators such as the compression spring 013 and the pressing pin 011 for supporting the compression spring are especially required in order to return the pressure receiving pin 08 and the shut-off pin 09 in case of mold releasing and it is necessary to ensure a space for the actuators.

In shaping, the shut-off pin 09 is held at a position for closing the vent passage 07 by a force owing to the difference of the pressure receiving areas between the pressure receiving pin 08 and the shut-off pin 09, but on the other hand the compression spring 013 gives the shut-off pin 09 a force in the direction to open the vent passage for weakening the force to hold the shut-off pin 09 at the closing position, therefore there is a fear that owing to some changes of the state the shut-off pin 09 moves to release the closing condition and the melt spouts out of the mold.

SUMMARY OF THE INVENTION

The present invention has been accomplished in view of the above-mentioned points and its object is to provide a breathing apparatus of a mold requiring no special actuating means for returning the breathing apparatus to an initial state and capable of preventing spouting of the melt out of the mold.

In order to achieve the above object, the present invention provides a breathing apparatus of a mold having a breathing groove communicating with a cavity, a detection chamber for detecting a melt pressure at an end portion of the breathing groove, a detour groove diverging from the detection chamber and a valve chamber communicating with a vent passage at an end portion of the detour groove which are formed on mating surfaces of a pair of mold members facing to each other.

The breathing apparatus comprises a shut-off valve member provided in one of the mold members with the vent passage and capable of reciprocating in a direction perpendicular to the mating surface; a valve element of the shut-off valve member having a tip end with a projection, positioned in the valve chamber and retracting to a closing position when the shut-off valve member moves to a direction separating from the mating surface; a detection pin provided in another mold member, capable of reciprocating in a direction Perpendicular to the mating surface and having an end portion with a projection fronting toward the detection chamber; an operation pin provided in the another mold member, capable of reciprocating in a direction perpendicular to the mating surface and having an end portion fronting toward the valve chamber to abut against the valve element; and a reverse mechanism connecting the detection pin to the operation pin for moving the pins in opposite directions to each other, whereby, when the detection pin detects a predetermined melt pressure in the detection chamber and retracts, the operation pin is Projected into the valve chamber through the reverse mechanism and pushes the shut-off valve member to bring the valve element into the closing position.

To close the valve, the shut-off valve member is pushed by the operation pin and moves to the direction retracting from the mating surface, accordingly, the pressure of the melt reaching the valve chamber acts on the shut-off valve member in the direction for closing the valve, so that tightness of the valve is improved, a reliable closed state can be maintained and spouting of the melt out of the mold can be prevented surely.

On mold releasing, solidified material in the detection chamber grasps the projection on the end portion of the detection pin so as to resist against the mold releasing. Therefore, the detection pin is drawn-out without any special actuating means and at the same time the operation pin is drawn-in through the reversing mechanism, thus the detection pin and the operation pin can be returned to the initial position. Solidified material in the valve chamber grasps the projection on the end portion of the shut-off valve member so as to resist against the mold releasing, therefore, the shut-off valve member can be drawn-out to the initial open position without any special actuating means.

Provided that the area of the end face of the detection pin fronting toward the detection chamber is set larger than the area of the end face of the operation pin fronting toward the valve chamber, a force corresponding to difference between pressure loads acting on the detection pin and the operation pin acts on the shut-off valve in its closing direction in moulding and the valve closes more surely.

Provided that the reverse mechanism is constituted by a turning lever having a pivotally supported central portion and both ends connected to the detection pin and the operation pin respectively, the apparatus can be more simplified and small-sized.

DETAILED DESCRIPTION OF THE PREFERRED EMBODIMENT

Figure 1:
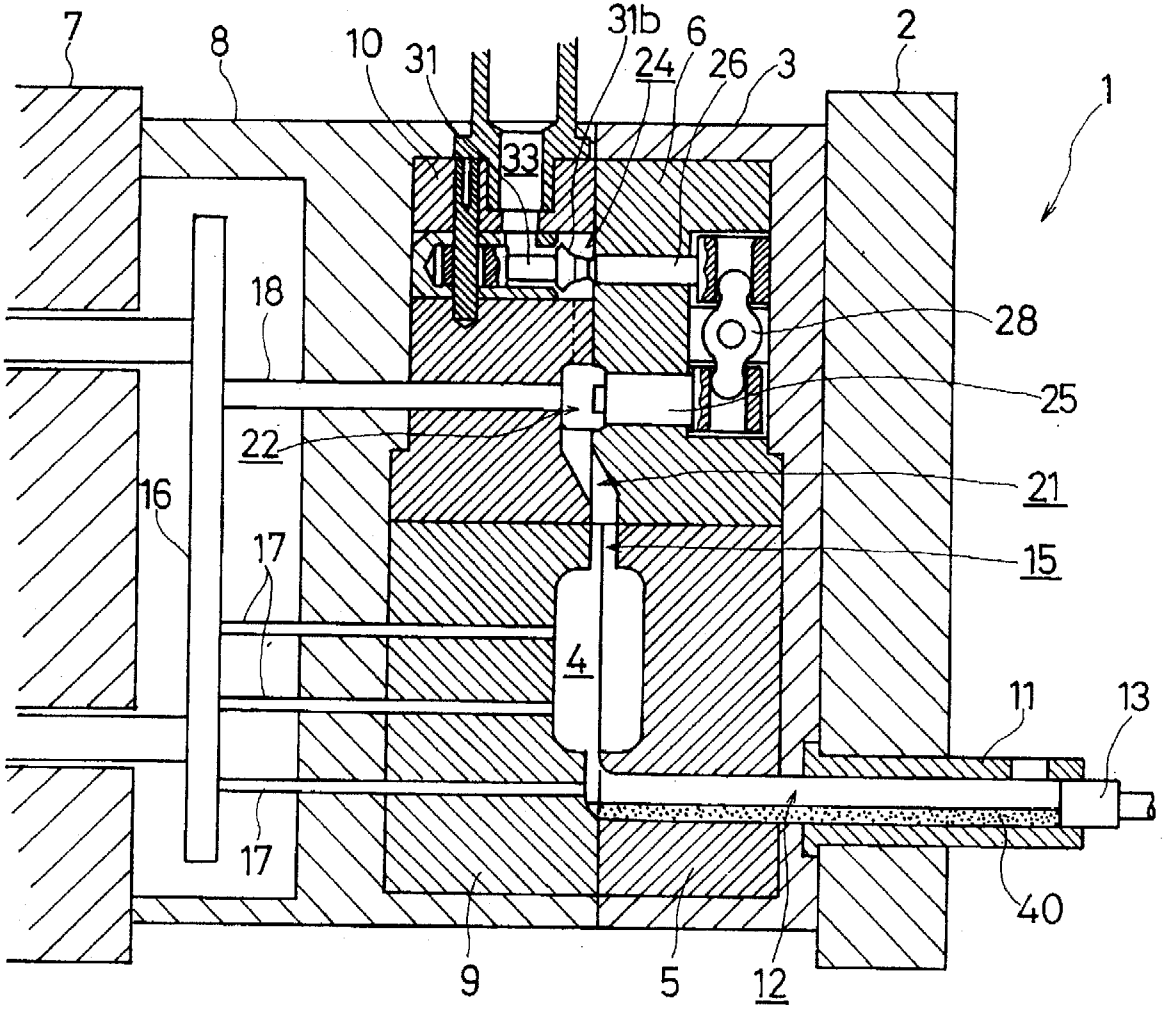
FIG. 1 is a sectional view of an essential part of a mold of a injection molding machine according to a preferred embodiment of the invention showing its closed state.

Hereinafter, the present invention will be described with reference to a preferred embodiment illustrated in FIGS. 1 to 7. FIG. 1 illustrates a section of an essential part of a mold of a injection moulding machine according to a preferred embodiment of the invention when the mold is closed. A fixed cavity mold member 5 forming a cavity 4 and a fixed breathing mould member 6 of the breathing apparatus are fitted in and fixed to a fixed main mold member 3 integrally connected to a fixed plate 2. On the other hand, a movable cavity mold member 9 forming a cavity 4 and a movable breathing mold member 10 of the breathing apparatus are fitted in and fixed to a movable main mold member 8 integrally connected to a movable plate 7.

The cavity 4 is formed on mating surfaces of the fixed cavity mold member 5 and the movable cavity mold member 9, and a pressurizing chamber 12 communicating with the cavity 4 and an interior of an injection sleeve 11 fitted to the fixed plate 2 is provided in the fixed cavity mold member 5 and the fixed main mold member 3. In the sleeve 11 is inserted an injection plunger 13 slidably. On the mating surfaces of the fixed cavity mold member 5 and the movable cavity mold member 9 is formed a breathing groove 15 being directed toward the breathing apparatus 20 from the cavity 4.

On the one hand, a push-out plate 16 is supported slidably relative to the movable plate 7 and the movable main mold member 8 integral therewith, three push-out pin 17 extending from the push-out plate 16 pass through the movable main mold member 8 and the movable cavity mold member 9 and tip ends of the push-out pins 17 are confronted with the cavity 4 or the pressurizing chamber 12. In addition, another push-out pin 18 is extended from the push-out plate 16 and passes through the movable main mold member 8 and the movable breathing mold member 10.

Figure 2:
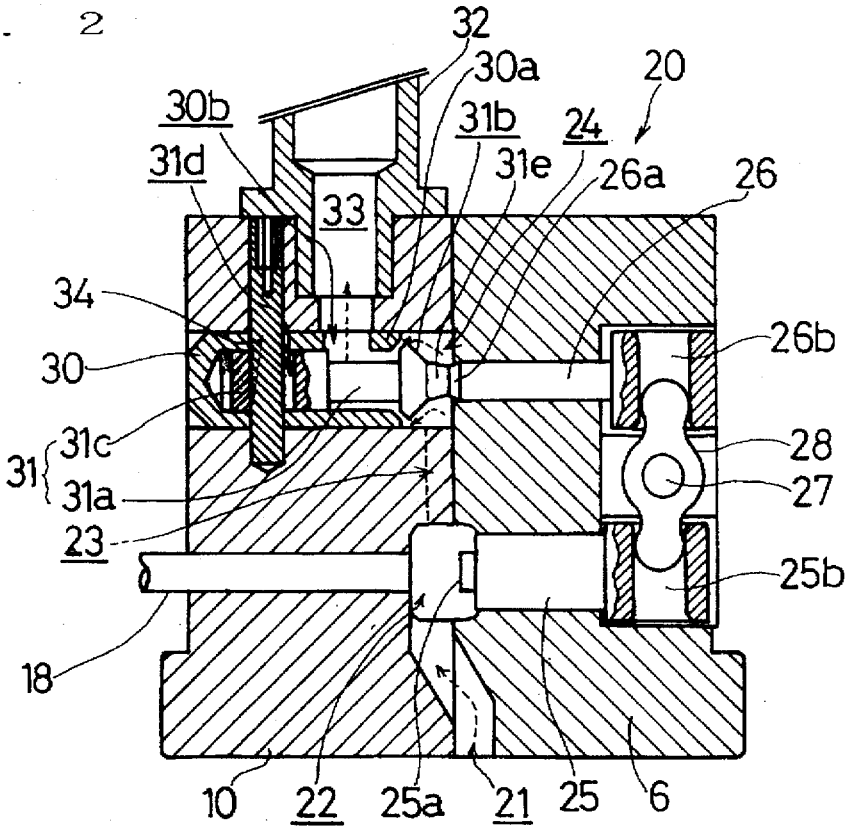
FIG. 2 is a sectional view of a breathing apparatus showing a state before molding.

FIGS. 2 to 5 each shows only the breathing apparatus on an enlarged scale. The state of the breathing apparatus of FIG. 2 is the same as that of FIG. 1. On the mating surfaces of the fixed breathing mold member 6 and the movable breathing mold member 10 is formed a breathing groove 21 communicating with the aforementioned breathing groove 15 at one end and at another end of the breathing groove 21 is formed a detection chamber 22. Detour grooves 23 diverging from the detection chamber 22 are formed on the side of the movable breathing mold member 10 in particular.

Figure 6:
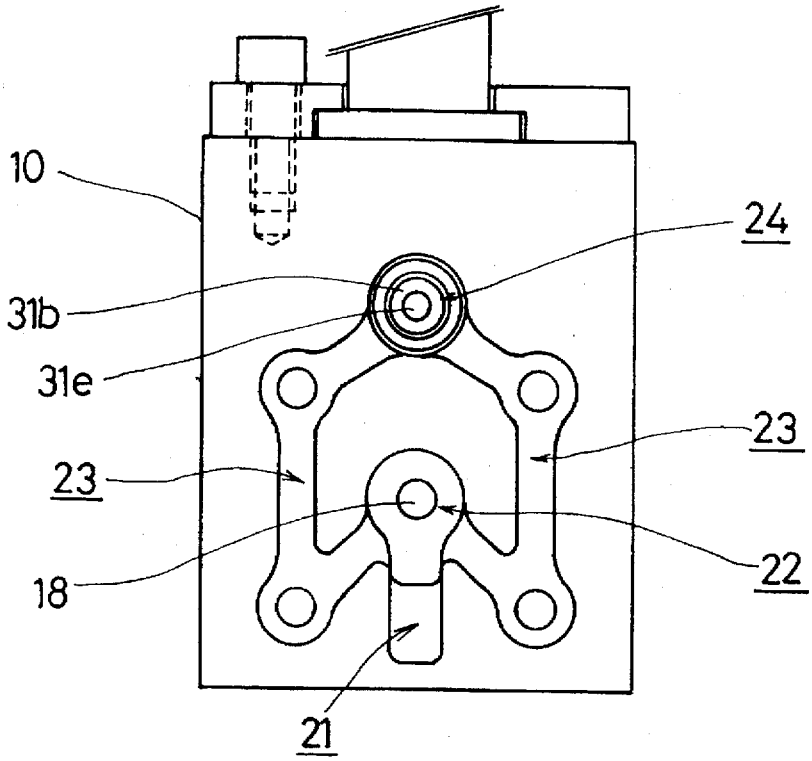
FIG. 6 s a view showing a mating surface of a movable breathing mold member.
Figure 7:
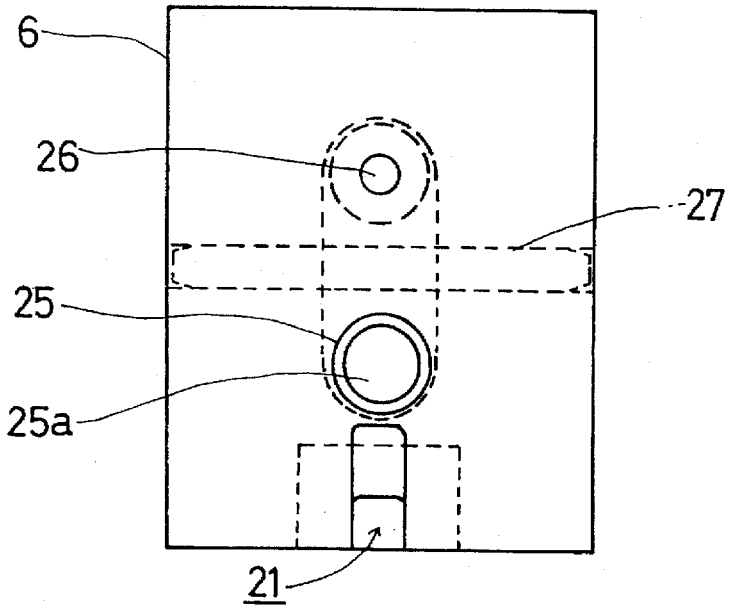
FIG. 7 is a view showing a mating surface of a fixed breathing mold member.
Figure 8:
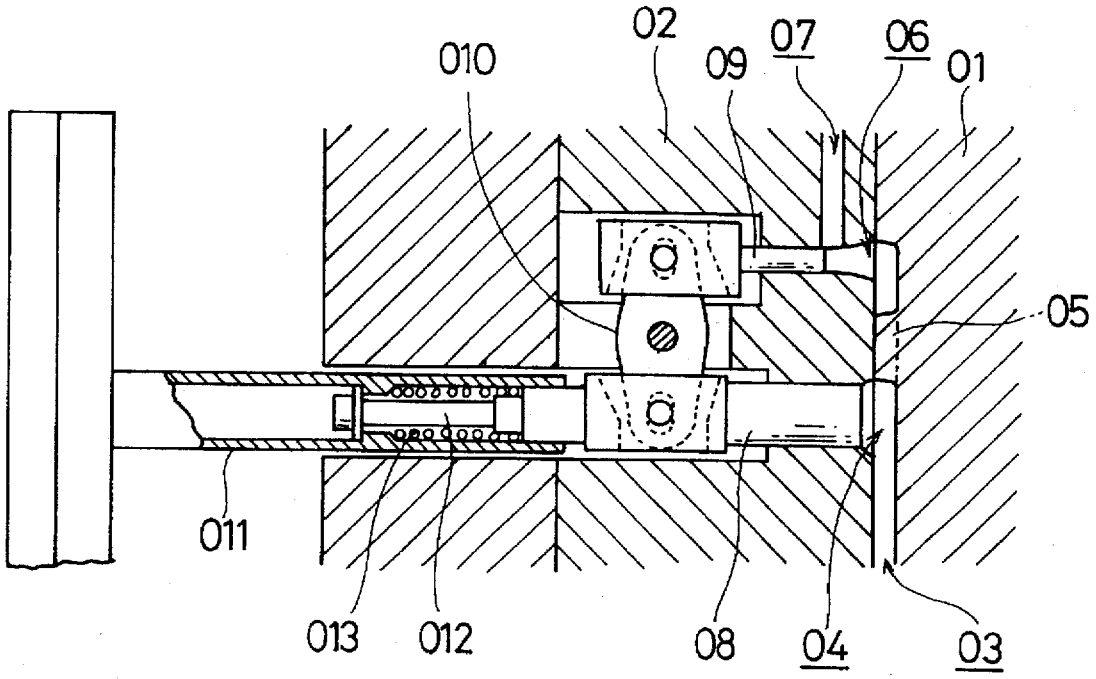
FIG. 8 PRIOR ART
FIG. 8 is a sectional view of an essential part of a customary breathing apparatus which is in a closed state.

FIG. 6 shows the mating surface of the movable breathing mould member 10. As shown in FIG. 6, the detour grooves 23 diverge from the detection chamber 22 to both sides, detour and gather again at a valve chamber 24. The detour grooves 23 are sharply bent at the detection chamber 22 in regard to the breathing groove 21. The tip end of the aforementioned push-out pin 18 passing through the movable breathing mold member 10 is confronted with the detection chamber 22.

In the fixed breathing mold member 6 are fitted slidably a detection pin 25 having a tip end confronted with the detection chamber 22 and a operation pin 26 parallel with the detection pin 25 having a tip end confronted with the valve chamber 24. The diameter of the detection pin 25 is larger than that of the operation pin 26. On the tip end of the detection pin 25 confronted with the detection chamber 22 is formed a projection **25*a*. The other end of the detection pin 25 is enlarged to form an engaging portion 25*b* engaging with an end of a turning lever 28. The tip end 26*a* of the operation pin 26 confronted with the valve chamber 24 is somewhat tapered and the other end of the operation pin 26 is enlarged to form a engaging portion 26*b* similar to the engaging portion 25*b***.

The turning lever 28 is pivotally supported at its central portion by a supporting shaft 27 and has upper and lower ends engaged and connected with the engaging portion **26*b* of the operation pin 26 and the engaging portion 25*b* of the detection pin 25, respectively. Thus, a reverse mechanism in which when the detection pin 25 moves before and behind the operation pin 26 is moved through the turning lever 28 in the opposite direction is constituted. The reverse mechanism utilizing the turning lever 28** as mentioned above is simple in construction and small in size.

The valve chamber 24 of the movable breathing mold member 10 is formed between the mating surface and an end peripheral portion 30*a* of a bottomed cylindrical valve bush 30 fitted from behind in a round hole penetrating the movable breathing mold member 10. A shut-off valve member 31 is slidably fitted in the valve bush 30. At a portion of the side wall of the valve bush 30 is formed a vent hole 30*b* which communicates with a vent pipe 32 having a tip end fitted in the movable breathing mold member 10 to form a vent passage 33.

The shut-off valve member 31 has a central columnar portion 31*a* of small diameter. An end of the central portion 31*a* positioned in the valve chamber 24 is enlarged to form a valve element 31*b* and the other end of the central portion 31*a* is also enlarged to form a columnar portion 31*c* having an outer diameter somewhat smaller than the inner diameter of the valve bush 30. The columnar portion 31*c* has a prolonged hole 31*d* formed in a direction perpendicular to the sliding direction and a valve pin 34 penetrating the movable breathing mold member 10 and the valve bush 30 passes through the prolonged hole 31*d*. The prolonged hole 31*d* is somewhat prolonged in the moving direction of the shut-off valve member 31 and the movement of the shut-off valve member 31 is limited by the valve pin 34 passing through the prolonged hole 31*d*.

The shut-off valve member 31 is coaxial with the operation pin 26 in the fixed breathing mold member 6 and the valve element 31*b* of the shut-off valve member 31 has a projection 31*e* capable of abutting against the tip end 26*a* of the operation pin 26.

FIG. 2 shows the state of the breathing apparatus when the valve is opened. The shut-off valve member 31 is moved toward the mating surface and the valve element 31*b* is separated from the end peripheral portion 30*a* to form a gap between them so that the valve chamber 24 communicates with the periphery of the columnar portion 31*a* of small diameter, the vent hole 30*b* and the vent passage 33 through the gap. If the shut-off valve member 31 shown in FIG. 2 moves apart the mating surface, the valve element 31*b* closes the end peripheral portion 30*a* of the valve bush 30 and the valve is closed.

Action processes of the injection molding machine 1 will be explained below in order.

At first, the mold is closed and the shut-off valve member 31 of the breathing apparatus 20 is set to the valve opening state. Melt 40 is poured into the pressurizing chamber 12 through an inlet of the injection sleeve 11 and the injection plunger 13 is advanced to push the melt 40 into the cavity at high velocity and high pressure.

Air in the cavity and reaction gas from the mold release agent pass through the breathing grooves 15, 21, the detection chamber 22, the detour grooves 23 and the valve chamber 24 opened at this time in order, and further they pass through the interior of the valve bush 30, the vent hole 30*b* and the vent passage 33 to be discharged out of the mold.

The melt 40 is pressed into the cavity 4 pushing out the gases, fills the cavity 4 and then flows into the breathing grooves 15, 21. When the melt reaches the detection chamber 22, the pressure within the detection chamber 22 is increased because the flow direction of the melt is abruptly changed toward the detour groove 23 and the detection pin 25 is pushed in. At the same time the operation pin 26 is moved in the opposite direction through the turning lever 28 and the tip end 26*a* projects into the valve chamber 24 to move together the shut-off valve member 31 having the projection 31*e* abutting against the tip end 26*a*.

Thus, the valve is closed by the movement of the shut-off valve member 31. Since the melt 40 flows along the detour grooves 23 after the detective chamber 22, the valve is closed before the melt reaches the valve chamber 24 and therefore the melt never spout outside.

Figure 3:
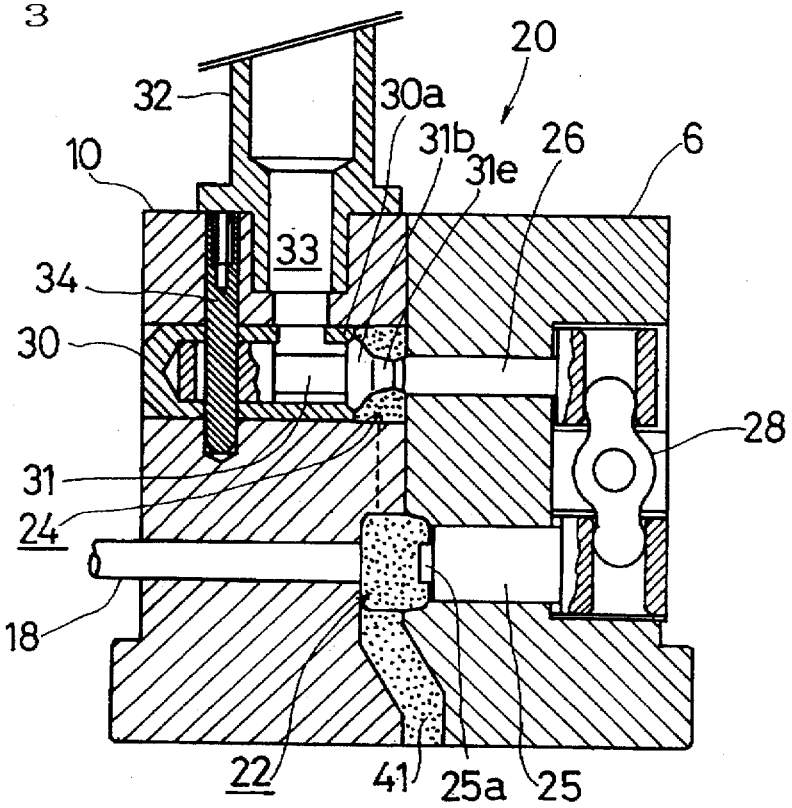
FIG. 3 is a sectional view of the breathing apparatus showing a state in molding.

FIG. 3 shows a state of the breathing apparatus after the valve is closed. The melt 40 has reached the valve chamber 24 and fills it. The melt pressure acts on the valve element 31*b* of the shut-off valve member 31 so as to assist and ensure the valve closing.

Since the pressure receiving area at the end face of the detection pin 25 is larger than that of the operation pin 26, the detection pin 25 is given a larger push-in force by the melt as compared with the operation pin 26, therefore the operation pin 26 is pushed out by the detection pin 25 through the turning lever 28 to force the shut-off valve member 31 in the direction to close the valve, and by this fact the valve closing state can be maintained more surely.

Figure 4:
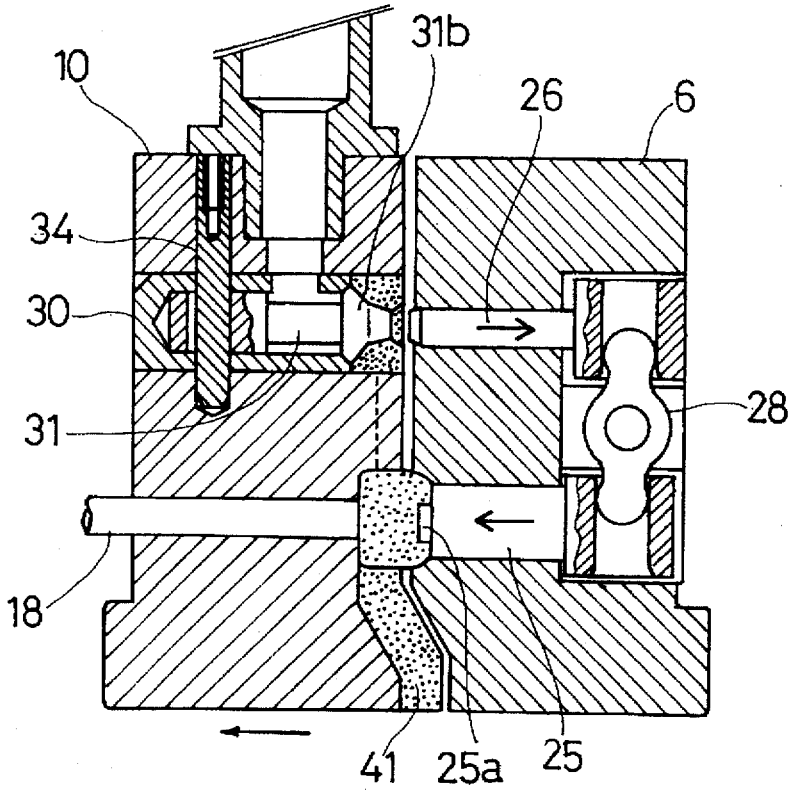
FIG. 4 s a sectional view of the breathing apparatus showing a state directly after mold releasing.
Figure 5:
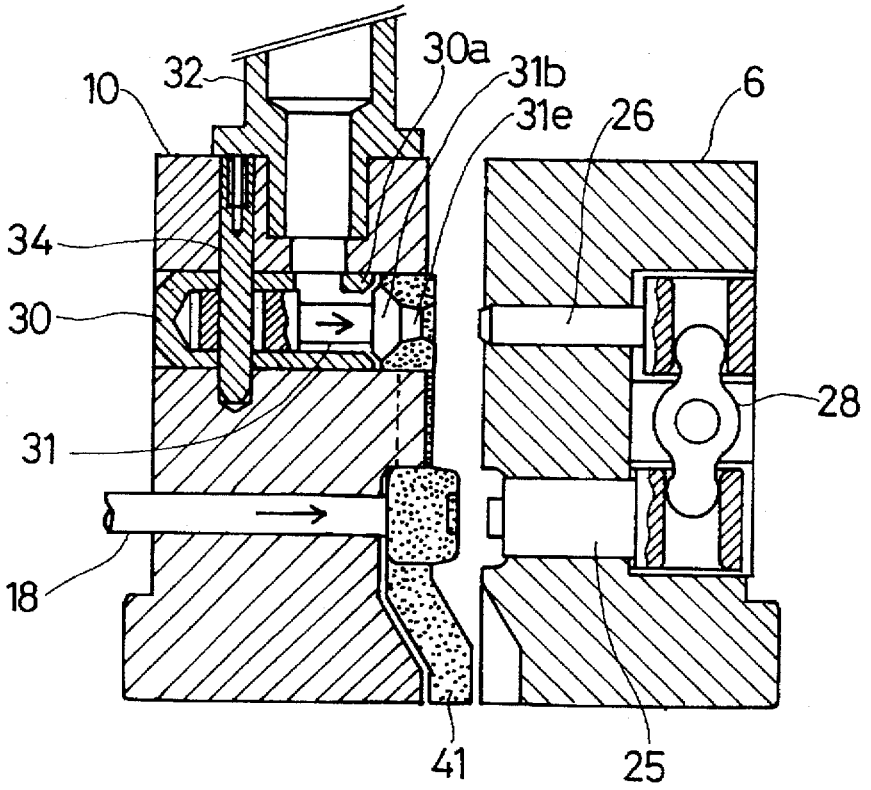
FIG. 5 is a sectional view of the breathing apparatus showing a state when solidified material is pushed out.

FIGS. 4 and 5 show states of the breathing apparatus on mold releasing. When the movable mold members 9, 10 are just separated from the fixed mold members 5, 6 (FIG. 4), solidified material 41 produced by that the melt is solidified in the detection chamber 22 grasps the projection 25*a* at the tip end of the detection pin 25 to exhibit a mold releasing resistance and the detection pin 25 is drawn-out to the side of the mating surface together with the solidified material 41. At the same time the operation pin 26 is drawn-in through the turning lever 28 so that the detection pin 25 and the operation pin 26 can be automatically returned to the initial positions.

When the push-out pins 17, 18 are actuated to remove the solidified material 41 together with the molded article from the movable molding members 9, 10 after mold releasing (FIG. 5), the solidified material 41 to be removed from the mold members grasps the projection 31*e* on the valve element 31*b* of the shut-off valve member 31 to exhibit a mold releasing resistance so that the shut-off valve member 31 is drawn-out and can be automatically returned to the initial position in the state of opening valve.

Accordingly, there is no need to provide a special driving device for returning the detection pin 25, the operation pin 26 and the shut-off valve member 31 to initial positions and therefore the construction of the mold can be simplified.

The molded article is taken out together with the solidified material 41 but owing to the above-mentioned breathing the mold article includes no gas intermixed and no gross porosity. The solidified material including gas is removed from the molded article in a later step.

What is claimed is:

1. A breathing apparatus of a mold, said mold having a breathing groove communicating with a cavity, a detection chamber for detecting a melt pressure at an end portion of said breathing groove, a detour groove diverging from said detection chamber, a valve chamber communicating with said detour groove, and a vent passage communicating with said valve chamber, said detour groove formed on one of mating surfaces of a pair of mold members forming said mold, said breathing apparatus comprising:

a shut-off valve member provided in one of said mold members, said shut-off valve member capable of reciprocating in a direction perpendicular to said mating surfaces of said pair of mold members;

a valve element of said shut-off valve member having a tip end with a projection, said valve element positioned in said valve chamber in an open position to allow communication between said vent passage and said cavity, and retractable in a closing position when said shut-off valve member moves in a direction opposite to said mating surfaces;

a detection pin provided in another of said mold members, said detection pin capable of reciprocating in a direction perpendicular to said mating surfaces and having an end portion with a projection fronting toward said detection chamber;

an operation pin provided in said another of said mold members, said operation pin capable of reciprocating in a direction perpendicular to said mating surfaces, said operating pin having an end portion butting against said valve element; and a reverse mechanism connecting said detection pin to said operation pin for moving said pins in opposite directions to each other, whereby, when said detection pin detects a predetermined melt pressure in said detection chamber and retracts, said operation pin is projected into said valve chamber through said reverse mechanism and pushes said shut-off valve member to bring said valve element into said closing position to close the vent passage from the cavity.

2. A breathing apparatus of a mold as described in claim 1, wherein an area of an end surface of said detection pin fronting toward said detection chamber is set larger than that of an end surface of said operation pin fronting toward said valve chamber.

3. A breathing apparatus of a mold as claimed in claim 1 or 2, wherein said reverse mechanism comprises a turning lever having a pivotally supported central portion and both ends connected to said detection pin and said operation pin respectively.

* * * * *